US005936205A

United States Patent [19]

Newmoyer

[11] Patent Number: 5,936,205

[45] Date of Patent: Aug. 10, 1999

[54] COMMUNICATION CABLE FOR USE IN A PLENUM

[75] Inventor: Kerry Newmoyer, Denver, Pa.

[73] Assignee: Alcatel, Claremont, N.C.

[21] Appl. No.: 08/742,084

[22] Filed: Oct. 31, 1996

Related U.S. Application Data

[63] Continuation-in-part of application No. 08/602,362, Feb. 16, 1996, abandoned, which is a continuation of application No. 08/337,564, Nov. 10, 1994, Pat. No. 5,493,071.

[51] Int. Cl.[6] ..... H01B 7/00

[52] U.S. Cl. ..... 174/113 R

[58] Field of Search ..... 174/113 R, 34, 174/110 FC, 121 A, 120 SR

[56] References Cited

U.S. PATENT DOCUMENTS

| | | | |
|---|---|---|---|
| 3,433,890 | 3/1969 | Gabriel et al. | 174/116 |
| 3,489,844 | 1/1970 | Motley | 174/32 |
| 3,650,827 | 3/1972 | Brown et al. | 428/383 |
| 3,678,177 | 7/1972 | Lawrensen | 174/113 C |
| 4,408,443 | 10/1983 | Brown et al. | 179/34 |
| 4,412,094 | 10/1983 | Dougherty et al. | 174/110 F |

(List continued on next page.)

FOREIGN PATENT DOCUMENTS

| | | |
|---|---|---|
| 0380245 | 8/1990 | European Pat. Off. . |
| 2518621 | 10/1976 | Germany . |

OTHER PUBLICATIONS

Polyolefin Resin Blends and Additive Technology: Advanced Non–Halogen Flame Retarded Compounds, M.J. Keough, pp. 47–56, copyright 1991, Union Carbide Chemicals & Plastics Technology Corp.

Underwriters Laboratory, Inc. File E70020, Project 84 ME8506, Report on Telephone Cable, Nov. 28, 1984.

Journal of Vinyl Technology, vol.7, No. 3, Sep. 1985 pp. 107–111.

International Wire & Cable Symposium Proceedings 1987, Reduced Emissions Plenum Cable Jacket Compounds, M.J. Keogh, pp. 592–597.

Teledyne Thermatics, Elm City, North Carolina, Type 2 Data & Telephone Plenum Cable, Drawing No. 12632/3, dated May 16, 1990, pp. 1–3.

Champlain Cable Corp. News Release, Notice #4, dated Feb. 8, 1990.

Champlain Cable Corp. Catalog No. 5, Plenum Cable, Computers, Communications, Control Fire Protection, Telephone, date unknown.

Underwriter's Laboratory Standard 910 Paper.

NIST Technical Note 1291, 1991, pp. vii, ix, x and 15–24.

1993 National Electric Code Handbook, 1993, pp. 855–862 and 891–895.

General Cable, Premise Wiring Products, Date unknown.

Underwriters Laboratories Inc., File E107869, Project 90ME13368, Report on Communications Cable, Teledyne Thermatics, Elm City, NC, Sep. 25, 1990.

Underwriters Laboratories Inc., File E113333, vol. 1, Sec. 14, Report on a Communications Cable, Issued Jul. 12, 1991, Revised Jan. 17, 1995, pp. 1–2.

*Primary Examiner*—Nestor Ramirez
*Assistant Examiner*—Joseph Waks
*Attorney, Agent, or Firm*—Ware, Fressola, Van der Sluys & Adolpholson LLP

[57] ABSTRACT

A communication cable includes at least one twisted pair of electrical conductors each having a surrounding layer of electrical insulation formed from fluroethylenepropylene (FEP) and at least one additional twisted pair of electrical conductors each having a surrounding layer of electrical insulation formed from an olefin based compound. The cable includes a cable jacket encasing the at least one twisted pair and the at least one additional twisted pair of electrical conductors. The cable meets or exceeds the requirements of the Underwriter's Laboratory UL Standard 910 Test Method For Fire and Smoke Characteristics of Cables Used In Air-Handling Spaces.

23 Claims, 2 Drawing Sheets

U.S. PATENT DOCUMENTS

| | | | |
|---|---|---|---|
| 4,423,589 | 1/1984 | Hardin et al. | 57/293 |
| 4,446,689 | 5/1984 | Hardin et al. | 57/204 |
| 4,500,748 | 2/1985 | Klein | 174/121 A |
| 4,605,818 | 8/1986 | Arroyo et al. | 174/107 |
| 4,687,294 | 8/1987 | Angeles | 385/102 |
| 4,697,051 | 9/1987 | Beggs et al. | 178/63 D |
| 4,722,959 | 2/1988 | Inoue et al. | 524/412 |
| 4,755,629 | 7/1988 | Beggs et al. | 174/34 |
| 4,873,393 | 10/1989 | Friesen et al. | 174/34 |
| 4,941,729 | 7/1990 | Hardin et al. | 385/107 |
| 4,969,706 | 11/1990 | Hardin et al. | 385/100 |
| 5,001,304 | 3/1991 | Hardin et al. | 174/107 |
| 5,010,210 | 4/1991 | Sidi et al. | 174/34 |
| 5,015,800 | 5/1991 | Vaupotic et al. | 174/34 |
| 5,024,506 | 6/1991 | Hardin et al. | 350/102 |
| 5,074,640 | 12/1991 | Hardin et al. | 385/109 |
| 5,155,789 | 10/1992 | LaNoane et al. | 385/106 |
| 5,162,609 | 11/1992 | Adriaenssens et al. | 174/34 |
| 5,173,960 | 12/1992 | Dickerson | 385/100 |
| 5,180,787 | 1/1993 | Shorr et al. | 525/282 |
| 5,202,946 | 4/1993 | Hardin et al. | 385/109 |
| 5,253,317 | 10/1993 | Allen et al. | 385/109 |
| 5,281,764 | 1/1994 | King et al. | 174/36 |
| 5,298,544 | 3/1994 | Goff et al. | 524/405 |
| 5,298,680 | 3/1994 | Kenny | 174/36 |
| 5,378,856 | 1/1995 | Allen | 174/120 R |
| 5,424,491 | 6/1995 | Walling et al. | 174/113 R |
| 5,514,837 | 5/1996 | Kenny et al. | 174/113 R |
| 5,563,377 | 10/1996 | Arpin et al. | 174/121 A |
| 5,576,515 | 11/1996 | Bleich et al. | 174/110 PM |
| 5,670,748 | 9/1997 | Gingue et al. | 174/120 R |

COMMUNICATION CABLE FOR USE IN A PLENUM

CONTINUATION DATA

This application is a continuation-in-part of application Ser. No. 08/602,362 filed on Feb. 16, 1996, now abandoned, which is a continuation of application Ser. No. 08/337,564 filed on Nov. 10, 1994, now U.S. Pat. No. 5,493,071.

BACKGROUND OF THE INVENTION

The present invention generally relates to a communication cable for use in a plenum and, in particular, relates to one such communication cable having a first plurality of twisted pairs of electrical conductors having a first insulating material about each electrical conductor thereof and a second plurality of twisted pairs of electrical conductors having a second insulating material about each electrical conductor thereof.

As communications and communication services have increased, it has become necessary to provide communication cables in larger and larger numbers. This is particularly true in office buildings where more and more communication services are being demanded. Typically, rather than rewire an existing building, it has been found more economical to provide the needed communication services by running the communication cables in plenums. In general, a plenum is defined as a compartment or chamber to which one or more air ducts are connected and which forms part of the air distribution system. Generally, in existing buildings, plenums are readily formed by providing drop ceilings, which is typically a return air plenum, in a facility being rewired. Another alternative is to create a plenum beneath a raised floor of a facility.

From the above it is readily understood why it would be very advantageous to utilized a wiring scheme within these fairly accessible places. However, since these plenums handle environmental air, considerable concern regarding a fire incidence is addressed in the National Electrical Code by requiring that communication cables for use in plenums pass a stringent flame and smoke evaluation. Consequently, in the manufacture of communication cables the fire resistance ratings which allow for installation within certain areas of a building are of primary importance.

Currently, communication cables for use in plenums must meet the requirements of the Underwriter's Laboratory UL Standard 910 which is a Test Method For Fire and Smoke Characteristics of Cables Used In Air-Handling Spaces. This is a well known test performed in a modified Steiner Tunnel (Steiner Tunnel). During the test, a single layer of 24 foot lengths of cable are supported on a one foot wide cable rack which is filled with cables. The cables are ignited with a 300,000 Btu/hr methane flame located at one end of the furnace for a duration of 20 minutes. Flame spread is aided by a 240 ft/minute draft. Flame spread is then monitored through observation windows along the side of the tunnel while concurrently monitoring smoke emissions through photocells installed within the exhaust duct. This is a severe test that to date has been passed by communication cables using premium materials such as low smoke materials, for example, Fluroethylenepropylene (FEP), Ethylene-chlorotrifluoroethylene (ECTFE), or Polyvinylidene fluoride (PVDF). In general, cables meeting this test are approximately three times more expensive than a lower rated cable designed for the same application. However, communication cables failing this test must be installed within conduit, thereby eliminating the benefits of an economical, easily relocatable cable scheme.

In general, the manufacture of communication cables are well known, for example, U.S. Pat. No. 4,423,589, issued to Hardin et al. on Jan. 3, 1984 discloses a method of manufacturing a communications cable by forming a S plurality of wire units by advancing groups of twisted wire pairs through twisting stations. Further, U.S. Pat. No. 4,446,689 issued to Hardin et al. on May 8, 1984 relates to an apparatus for manufacturing a communications cable wherein disc frames are provided with aligned apertures in which faceplates movably mounted. During operation, the faceplates are modulated in both frequency and amplitude.

The current materials for use in communications are also well known, for example, U.S. Pat. No. 5,001,304 issued to Hardin et al. on Mar. 19, 1991 relates to a building riser cable having a core which includes twisted pairs of metal conductors. Therein the insulating covers are formed from a group of materials including polyolefin. It should be noted however, that all of the insulating covers are the same and that the flame test used for riser cables is much less severe than the flame test used for plenum cables.

U.S. Pat. No. 5,024,506 issued to Hardin et al. on Jun. 18, 1991 discloses a plenum cable that includes non-halogenated plastic materials. The insulating material about the metallic conductors is a polyetherimide. Again the insulating material is the same for all of the conductors. Further, in U.S. Pat. No. 5,074,640 issued to Hardin et al. on Dec. 24, 1991 a plenum cable is described that includes an insulator containing a polyetherimide and an additive system including an antioxidant/thermal stabilizer and a metal deactuator. As is the convention, the insulator is the same for all of the metallic conductors.

U.S. Pat. No. 5,202,946 issued to Hardin et al. on Apr. 13, 1993 describes a plenum cable wherein the insulation includes a plastic material. The insulation is the same for all of the conductors within the plenum cable. European Patent 0 380 245 issued to Hardin et al. describes another plenum cable having insulation about the metallic conductors that, in this case, is a plastic material including a polyetherimide. As is the convention the insulation is the same for all of the conductor.

Further, U.S. Pat. No. 4,941,729 describes a cable that is intended as a low hazard cable. This patent describes a cable that includes a non-halogenated plastic material. Similarly, U.S. Pat. No. 4,969,706 describes a cable that includes both halogenated and non-halogenated plastic materials. In both patents the insulating material about the twisted pairs of conductors is the same for each cable.

U.S. Pat. No. 4,412,094 issued to Dougherty et al. on Oct. 25, 1983 relates to a riser cable having a composite insulator having an inner layer of expanded polyethylene and an outer layer of a plasticized polyvinyl chloride. All of the conductors include the same composite insulator.

U.S. Pat. No. 4,500,748 issued to Klein on Feb. 19, 1985 relates to a flame retardant plenum cable wherein the insulation and the jacket are made from the same or different polymers to provide a reduced amount of halogens. This reference tries to predict, mathematically, the flame spread performance of cables within the Steiner tunnel. The method does not consider configurations of designs. Further, synergistic effects or the smoke generation of the design against UL 910 test requirements are not addressed. In each embodiment, the insulation is the same for all of the conductors.

U.S. Pat. No. 4,605,818 issued to Arroyo et al. on Aug. 12, 1986 relates to a flame retardant plenum cable wherein the conductor insulation is a polyvinyl chloride plastic provided with a flame retardant, smoke suppressive sheath system. As is common throughout the known communication cables the conductor insulation is the same for all of the conductors.

U.S. Pat. No. 4,678,294 issued to Angeles on Aug. 18, 1987 relates to a fiber optic plenum cable. The optical fibers are provided with a buffer layer surrounded by a jacket. The cable is also provided with strength members for rigidity.

U.S. Pat. No. 5,010,210 issued to Sidi et al. on Apr. 23, 1991 describes a non-plenum telecommunications cable wherein the insulation surrounding each of the conductors is formed from a flame retardant polyolefin base compound.

U.S. Pat. No. 5,162,609 issued to Adriaenssens et al. on Nov. 10, 1992 relates to a fire-resistant non-plenum cable for high frequency signals. Each metallic member has an insulation system. The insulation system includes an inner layer of a polyolefin and an outer layer of flame retardant polyolefin plastic.

U.S. Pat. No. 5,253,317 issued to Allen et al. on Oct. 12, 1993 describes a non-halogenated plenum cable including twisted pairs of insulated metallic conductors. The insulating material is a non-halogenated sulfone polymer composition. The insulating material is the same for all of the metallic conductors.

It can thus be understood that much work has been dedicated to providing not only communication cables that meet certain safety requirements but meet electrical requirements as well. Nevertheless, the most common communication cable that is in widest use today includes a plurality of twisted pairs of electrical conductors each having an insulation of FEP, which is a very high temperature material and possesses those electrical characteristics, such as, low dielectric constant and dissipation factor, necessary to provide high quality communications cable performance. However, FEP is quite expensive and is frequently in short supply.

Consequently, the provision of a communication cable for use in plenums but has a reduced cost and reduced use of FEP is highly desired.

SUMMARY OF THE INVENTION

Accordingly, it is one object of the present invention to provide a communication cable for use in a plenum which reduces the amount of FEP or other expensive materials and hence, reduces the cost of the communication cable.

This object is accomplished, at least in part by the a communication cable that has a first plurality of twisted pairs of electrical conductors having a first insulating material about each electrical conductor thereof and a second plurality of twisted pairs of electrical conductors having a second insulating material about each electrical conductor thereof.

In one particular aspect of the invention, the communication cable includes a plurality of twisted pairs of electrical conductors insulated with a material that is a plenum rated material such as FEP and at least one additional twisted pair of electrical conductors insulated with an Olefin base insulation material. As used herein the phrase "plenum rated insulation" includes those materials, such as FEP, that would allow a cable to pass standard industry plenum tests if it were used on all of the twisted pairs of electrical conductors of a cable. Correspondingly, the phrase "non-plenum rated insulation" includes those materials, such as the Olefin base material used in the communication cable of the invention, that would significantly contribute to a cable failing standard industry plenum tests if it were used on all of the twisted pairs of electrical conductors of a cable. Typically, these non-plenum materials provide too much fuel contribution to the flame test either through a low melting point or a high fuel content or a combination of these factors. Non-plenum materials may also contribute excessively to the smoke generation of the cable under test, thus rendering the cable unsuitable for plenum applications. In such a communication cable the insulation material can be an olefin which is a material usually reserved for use in non-plenum application, for example, in riser cables.

Other objects and advantages will become apparent to those skilled in the art from the following detailed description of the invention read in conjunction with the appended claims and the drawings attached hereto.

BRIEF DESCRIPTION OF THE DRAWINGS

The drawings, not drawn to scale, include.

DETAILED DESCRIPTION OF THE PREFERRED EMBODIMENT

Figure 1:
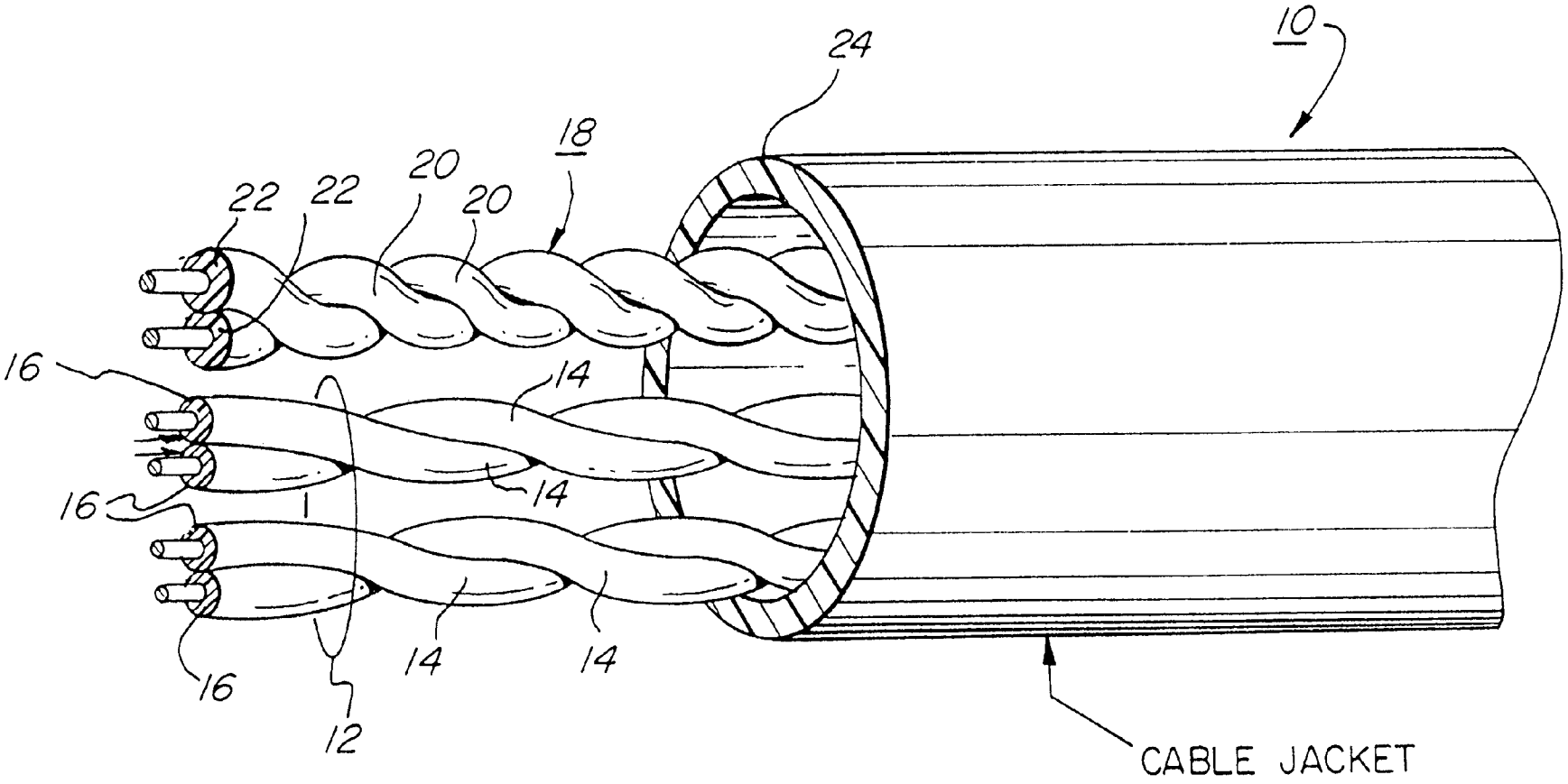
FIG. 1 which is a perspective view of a communication cable embodying the principles of the present invention.
Figure 2:
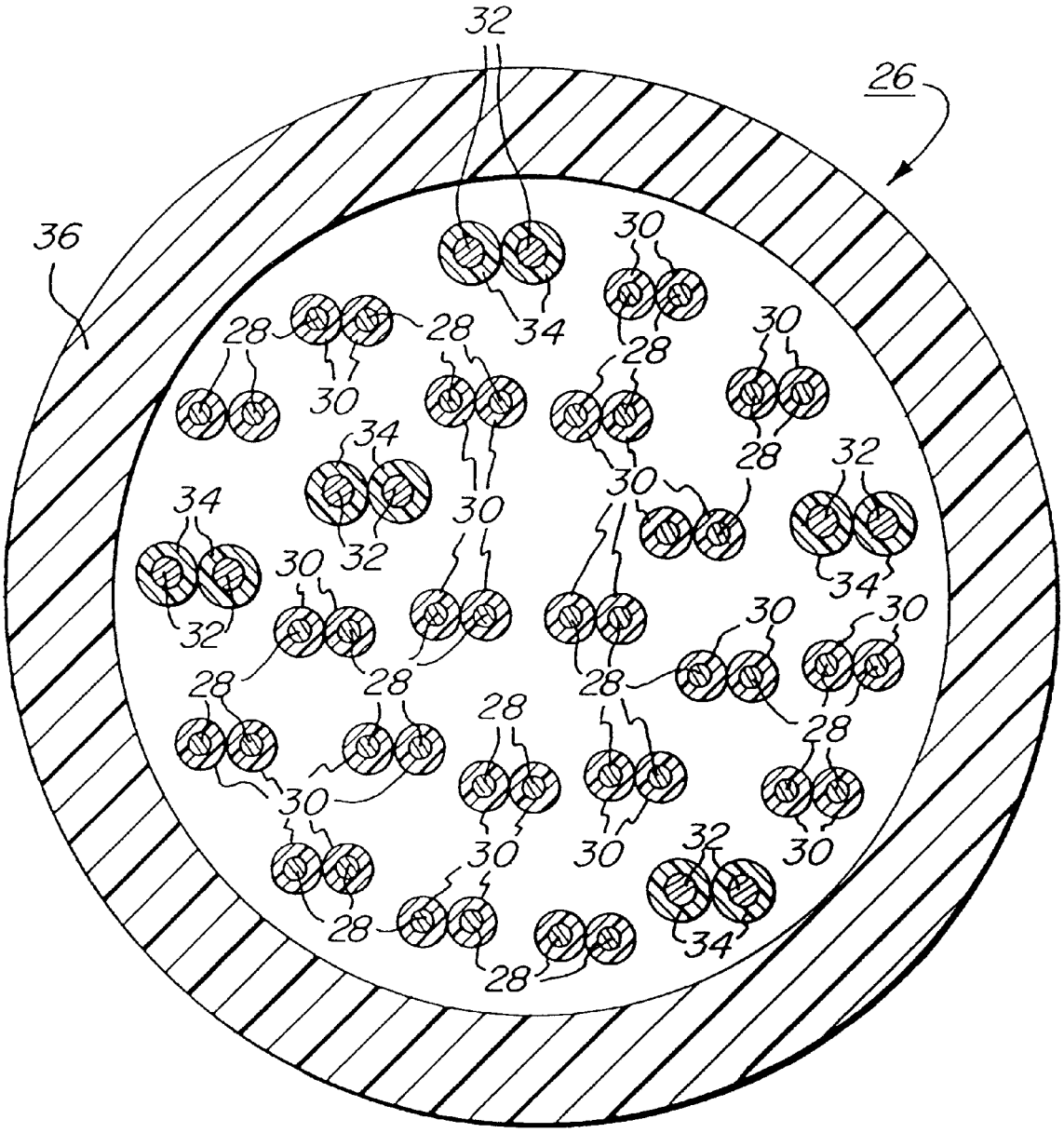
FIG. 2 which is a cross-sectional view of the communication cable of FIG. 1.

A communication cable, generally indicated at 10 in FIG. 1 and embodying the principles of the present invention, includes a plurality of twisted pairs 12 of electrical conductors each member 14 of the twisted pairs 12 being surrounded by a layer 16 of insulation material and at least one other twisted pair 18 of electrical conductors each member 20 thereof surrounded by a layer 22 of insulation material that is different from the material of the layer 16 of insulation material of the twisted pairs 12. In one preferred embodiment, the plurality of twisted pairs 12 and the twisted pair 18 are surrounded by a cable jacket 24.

In one particular embodiment, each of the twisted pairs, 12 and 18, is provided with a twist length. In an embodiment wherein the communication cable 10 includes four twisted pairs, one or two of the twisted pairs are twisted pairs 18 having a layer 22 of insulation material different from the other twisted pairs 12 of electrical conductors.

In one specific embodiment, the communication cable includes three insulated twisted pairs 12 of electrical conductors each having a nominal diameter of about 0.034 inches. This includes an electrical conductor having a nominal diameter of about 0.0201 inches and a layer 16 of insulation having a thickness of about 0.0065 inches. For these twisted pairs 12 of electrical conductors the layer 16 of insulation can be any plenum rated insulation, such as, for example, FEP. In this embodiment, each of the insulated twisted pair 18 of electrical conductors has a nominal diameter of about 0.205 inches and a layer 22 of insulating material having a thickness of about 0.0085 inches.

As is well known in the art, the FEP insulation material 16 may be obtained in the form of pelletized material which is extruded over the electrical conductors using a turn screw extruder.

Preferably, the layer 22 of insulation material of the twisted pair 18 is an olefin base material which is a modified non-plenum material. For example, such an insulation material 22 may be a combination of highly brominated and antimony trioxide filled high density polyethylene (HDPE) combined with standard HDPE. As another example, the insulation layer 22 may also be a hydrated mineral filled polyolefin copolymer blended with HDPE. Although other combinations can be used it is preferred that the combination is blended at a 50/50 to 75/25 blend ratio of the flame retarded HDPE (FRPE) to the standard HDPE. Such combinations improve the flame retardancy and smoke suppression of the material as well as reduces the fuel load by removing HDPE while maintaining electrical performance. Two such cables have successfully passed the Steiner tunnel test.

In another embodiment of the invention, the olefin base insulation material includes a flame-retarded polypropylene (FRPP) blended with either polyethylene or high density polyethylene. Alternatively, the olefin base material may include only a flame retarded polypropylene base insulation material. The olefin base material is filled with flame retardants and char enhancers to minimize smoke and flame evolution. For example, the insulation material may contain 0–5 pph antimony trioxide flame retardant. Additionally, the insulation may contain 0–30 pph halogen flame retardant, such as 15 pph brominated flame retardant. One suitable brominated flame retardant is decabromodiphenyloxide sold under the name SAYTEK 102 and manufactured by Great Lakes. Alternatively, a chlorinated flame retardant such as DECLORANE may be used. The compound may also contain small percent lubricants such as waxes or stearates and stabilizers such as tetrakismethylene (3,5-di-t-buyl-4-hydroxhydrocinnamate) methane. Additionally, the compound may contain about 10% by weight polyethylene which may be used as a process aid. The compound may contain up to 120 parts per hundred mineral filler, and up to 5 parts per hundred silicate char enhancers such as talc. Suitable mineral fillers include magnesium carbonate or magnesium hydroxide (treated with coupling agents). Other suitable mineral fillers, such as calcium carbonate, may be used. Another suitable mineral filler, which may be used as both a foaming agent and a miner filler, is Alumina Trihydrate (ATH), also commonly known as Aluminum Hydroxide. In addition to silicate char enhancers, other char formers may be used such as Polytetrafluorethylene (PTFE), Nitrogen-Phosphate or Ammonium-Polyphosphate. The smoke suppression of the compound may also be enhanced with a suitable compound, such as a zinc compound.

The formulation for the olefin base insulation material is given in Table I below in part by weight:

| INSULATION MATERIAL | PARTS PER HUNDRED |
|---|---|
| POLYPROPYLENE | 100 |
| MINERAL FILLER | 50 to 150 |
| FLAME RETARDANT | 0 to 30 |
| LUBRICANTS | .10 to 5 |
| STABILIZERS | .10 to 5 |
| POLYETHYLENE (or HIGH DENSITY POLYETHYLENE) | 0–75 |

The components of the insulation material were combined in a twin screw extruder. The pelletized insulation material was then extruded over the metal conductors.

It has been found that when using such a configuration, the different dielectric constants of the two insulating materials (FEP and Olefin base) cause a problem with respect to phase differences and time delay skew when transmitting electrical signals over the twisted pairs of the cable. It has been found that by reducing the twist length of the electrical conductors insulated with FEP, the effective electrical length of these electrical conductors is increased, thereby changing the effective dielectric constant of the conductors insulated with FEP. Therefore, by providing the electrical conductors insulated with FEP with a shorter twist length with respect to the electrical conductors insulated with the olefin base material, the difference in the effective dielectric constants of the insulation materials on the twisted pairs is minimized, thereby improving the time delay skew resulting from the different dielectric materials.

An important factor in selecting the twist length of the conductors insulated with FEP and the conductors insulated with olefin base material is the difference between the longest twist length of the conductors insulated with FEP and the shortest twist length of conductors insulated with olefin based material. The greater the difference can be made, the greater the effect in reducing the time delay skew characteristics of the cable.

To effect the desired time delay skew improvement through twist lay modification, the twisted pairs insulated with olefin based material will have a much longer lay length than the twisted pairs insulated with FEP. One such twist lay combination found to be acceptable is 0.50" and 0.53" on the FEP insulated pairs and 0.75" and 0.90" on the Olefin base insulated pairs. In this instance, the longer twist lay of 0.53" on the FEP insulated pair and the shorter twist lay of 0.75" on the Olefin base insulated pair will define the highest time delay skew for the cable. However, as is well known, there is a problem associated with providing long lay lengths for twisted pairs. Generally speaking, the longer lay lengths of twisted pairs, the worse the cross-talk between those twisted pairs. As is known in the art, the term "cross-talk" relates to the dynamic, inductive effects of parallel and adjacent conductors, which is particularly severe at high frequencies or high data rates and over long distances. The effects of cross-talk effectively limits the frequency range, bit rate, cable length, signal-to-noise ratio as well as the number of conductor pairs which can be used within a single cable for signal transmission. However, by carefully selecting the pair lays and by configuring the long lay lengths catecorner to one another, the problems associated with cross-talk for long lays may be eliminated or significantly reduced.

In the preferred embodiment, the communication cable 10 includes a cable jacket 24 that encases the plurality of twisted pairs 12 and the at least one twisted pair 18. Preferably, the cable jacket 24 is formed from polyvinylchloride (PVC). However, other material, such as, for example, polymer alloys and Ethylene-Trichlorofluoroethylene (E-CTFE) have also passed the modified Steiner tunnel test and may also be used.

Examples of cables manufactured in accordance with the invention were subjected to tests in a modified Steiner Tunnel in accordance with UL Standard 910. The results of the tests are as follows in Table II:

| | | PROPERTY | | |
|---|---|---|---|---|
| CABLE | | PEAK SMOKE | AVERAGE SMOKE | FLAME SPREAD (feet) |
| NEC Code Requirement | | 0.5 | .15 | 5.0 |
| Example | Sample 1 | 0.35 | 0.10 | 1.0 |
| Cable #1 | Sample 2 | 0.37 | 0.09 | 1.5 |
| Example | Sample 1 | 0.29 | 0.11 | 4.5 |
| Cable #2 | Sample 2 | 0.38 | 0.11 | 4.5 |
| | Sample 3 | 0.26 | 0.12 | 4.0 |
| | Sample 4 | 0.27 | 0.15 | 5.0 |
| Example | Sample 1 | 0.46 | 0.14 | 2.0 |

-continued

| CABLE | | PROPERTY | | |
|---|---|---|---|---|
| | | PEAK SMOKE | AVERAGE SMOKE | FLAME SPREAD (feet) |
| Cable #3 | Sample 2 | 0.30 | 0.12 | 1.5 |
| Example | Sample 1 | 0.38 | 0.13 | 1.0 |
| Cable #4 | Sample 2 | 0.38 | 0.13 | 1.0 |
| Example | Sample 1 | 0.41 | 0.11 | 1.0 |
| Cable #5 | Sample 2 | 0.35 | 0.13 | 1.5 |

Example cable 1 included a communications cable having three (3) twisted pairs insulated with FEP and one (1) twisted pairs insulated with an olefin base material. The cable included a PVC alloy jacket. The olefin base material included a composition of flame retarded polyethylene (FRPE) and high density polyethylene (HDPE) in a 75/25 ratio. Example cable 2 included a communications cable having four (4) twisted pairs insulated with an olefin base material. The cable included a PVC alloy jacket. The olefin base material included a composition of flame-retarded polyproplyene (FRPP). Example cable 3 included a communications cable having two (2) twisted pairs insulated with FEP and two (2) twisted pairs insulated with an olefin base material. The cable included a PVC alloy jacket. The olefin base material included a composition of 80% flame retarded polyproplyene (FRPP) and 20% HDPE. Example cable 4 included a communications cable having two (2) twisted pairs insulated with FEP and two (2) twisted pairs insulated with an olefin base material. The cable included a PVC alloy jacket. The olefin base material included a composition of foamed flame retarded polyproplyene (FRPP). The FRPP was foamed with ATH. Example cable 5 included a communications cable having three (3) twisted pairs insulated with FEP and one (1) twisted pairs insulated with an olefin base material. The cable included a PVC alloy jacket. The olefin base material included a composition of 90% flame retarded polyproplyene (FRPP) and 10% HDPE.

Although the present invention has been described and illustrated with respect to exemplary embodiments thereof, it will be understood by those skilled in the art that the foregoing and various other additions and omissions may be may therein and thereto without departing from the spirit and scope of the invention. Hence, the present invention is limited only by the appended claims and the reasonable interpretation thereof.

What is claimed is:

1. A communication cable for use in a plenum, said cable comprising:

at least one twisted pair of electrical conductors, each of said electrical conductors of said at least one twisted pair having a single surrounding layer of electrical insulation formed from a first material which is fluroethylenepropylene (FEP);

at least one additional twisted pair of additional electrical conductors, each of said additional electrical conductors of said at least one additional twisted pair having a single surrounding layer of electrical insulation formed from a second material which is an olefin based compound;

a cable jacket encasing said at least one twisted pair and said at least one additional twisted pair; and wherein said cable meets or exceeds the requirements of the Underwriter's Laboratory UL Standard 910 Test Method for Fire and Smoke Characteristics of Cables Used in Air-Handling Spaces.

2. The communication cable as claimed in claim 1 wherein said second material is a highly brominated and antimony trioxide filled HDPE blended with HDPE.

3. The communication cable as claimed in claim 1 wherein said second material is a hydrated mineral filled polyolefin copolymer HDPE.

4. The communication cable as claimed in claim 1 wherein said cable jacket is formed from an ethylene-trichlorofluoroethylene.

5. The communication cable as claimed in claim 1 wherein said cable jacket is formed from a polymer alloy.

6. The communication cable as claimed in claim 5 wherein said cable jacket is formed from a polyvinylchloride.

7. The communication cable as claimed in claim 1 wherein said at least one twisted pair and said at least one additional twisted pair of electrical conductors have different twist lengths.

8. The communication cable as claimed in claim 7 wherein said at least one twisted pair has the shortest twist length.

9. The communication cable as claimed in claim 1 wherein said second material is a flame-retarded polypropylene (FRPP) base insulation material.

10. The communication cable as claimed in claim 9 wherein said flame-retarded polypropylene base insulation material is blended with either polyethylene or high-density polyethylene.

11. The communication cable as claimed in claim 1 wherein said olefin based material is filled with flame retardant and char enhancer to minimize smoke and flame evolution.

12. The communication cable as claimed in claim 11 wherein said olefin based material contains between 0 and 5 parts per hundred antimony trioxide flame retardant.

13. The communication cable as claimed in claim 11 wherein said olefin based material contains between 0 and 30 parts per hundred halogen flame retardant.

14. The communication cable as claimed in claim 13 wherein said halogen flame retardant is a brominated flame retardant.

15. The communication cable as claimed in claim 14 wherein said brominated flame retardant is decabromodiphenyloxide.

16. The communication cable as claimed in claim 11, wherein said flame retardant is a chlorinated flame retardant.

17. The communication cable as claimed in claim 11, wherein said olefin based material contains lubricants, waxes or stearates, and stabilizers.

18. The communication cable as claimed in claim 1, wherein said olefin based material contains between 50 and 150 parts per hundred mineral filler.

19. The communication cable as claimed in claim 18, wherein said mineral filler is magnesium carbonate.

20. The communication cable according to claim 18, wherein said mineral filler is magnesium hydroxide.

21. The communication cable as claimed in claim 11, wherein said char enhancer is selected from the group including silicate char enhancers, polytetrafluroethylene (PTFE), nitrogen-phosphate or ammonium-polyphosphate.

22. The communication cable as claimed in claim 11 wherein said at least one twisted pair and said at least one additional twisted pair of electrical conductors have different twist lengths.

23. The communication cable as claimed in claim 22 wherein said at least one twisted pair has the shortest twist length.

* * * * *